US009771796B2

(12) United States Patent
Irani et al.

(10) Patent No.: US 9,771,796 B2
(45) Date of Patent: Sep. 26, 2017

(54) WELL FLUID SAMPLING CONFIRMATION AND ANALYSIS

(71) Applicant: Halliburton Energy Services, Inc., Houston, TX (US)

(72) Inventors: Cyrus Aspi Irani, Houston, TX (US); Scott Luke Miller, Highland Village, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 254 days.

(21) Appl. No.: 14/397,260

(22) PCT Filed: Dec. 30, 2013

(86) PCT No.: PCT/US2013/078266
§ 371 (c)(1),
(2) Date: Oct. 27, 2014

(87) PCT Pub. No.: WO2015/038179
PCT Pub. Date: Mar. 19, 2015

(65) Prior Publication Data

US 2016/0265353 A1 Sep. 15, 2016

Related U.S. Application Data

(60) Provisional application No. 61/878,243, filed on Sep. 16, 2013.

(51) Int. Cl.

| | |
|---|---|
| ***E21B 49/08*** | (2006.01) |
| ***E21B 47/12*** | (2012.01) |
| ***E21B 47/06*** | (2012.01) |

(52) U.S. Cl.
CPC ..... *E21B 49/081* (2013.01); *E21B 47/06* (2013.01); *E21B 47/12* (2013.01); *E21B 49/088* (2013.01); *E21B 47/065* (2013.01); *E21B 49/084* (2013.01)

(58) Field of Classification Search
None
See application file for complete search history.

(56) References Cited

U.S. PATENT DOCUMENTS 5,470,377 A * 11/1995 Whitlock ..... B01D 53/04 95/106
6,216,782 B1 4/2001 Skinner
7,197,923 B1 4/2007 Wright et al.
(Continued)

OTHER PUBLICATIONS

Authorized Officer Chan Yoon Hwang, PCT International Search Report and Written Opinion of the International Searching Authority, PCT/US2013/078266, dated Jun. 3, 2014, 14 pages.
(Continued)

*Primary Examiner* — Caroline N Butcher
(74) *Attorney, Agent, or Firm* — John W. Wustenberg; Parker Justiss, P.C.

(57) ABSTRACT

An in-well type sampling system including a sampling chamber actuable to receive a fluid sample and a pressure source coupled to the sampling chamber to supply pressure to the sampling chamber after the sampling chamber actuating. A pressure sensor is provided in communication with the pressure source to measure the pressure of the pressure source. A telemetry communicator is coupled to the pressure sensor to send a signal from the pressure sensor away from the sampling system.

16 Claims, 4 Drawing Sheets

(56) References Cited

U.S. PATENT DOCUMENTS

| | | | | |
|---|---|---|---|---|
| 7,395,712 | B2 | 7/2008 | Irani et al. | |
| 7,472,589 | B2 | 1/2009 | Irani et al. | |
| 7,596,995 | B2 | 10/2009 | Irani et al. | |
| 7,634,946 | B2 | 12/2009 | Irani et al. | |
| 7,762,130 | B2 | 7/2010 | Irani et al. | |
| 7,856,872 | B2 | 12/2010 | Irani et al. | |
| 7,874,206 | B2 | 1/2011 | Irani et al. | |
| 7,926,342 | B2 | 4/2011 | Irani et al. | |
| 7,946,166 | B2 | 5/2011 | Irani et al. | |
| 7,950,277 | B2 | 5/2011 | Irani et al. | |
| 7,966,876 | B2 | 6/2011 | Irani et al. | |
| 7,967,067 | B2 | 6/2011 | Irani et al. | |
| 8,146,660 | B2 | 4/2012 | Irani et al. | |
| 8,215,390 | B2 | 7/2012 | Irani et al. | |
| 8,215,391 | B2 | 7/2012 | Irani et al. | |
| 8,429,961 | B2 | 4/2013 | Irani et al. | |
| 8,474,533 | B2 | 7/2013 | Miller et al. | |
| 8,547,556 | B2 | 10/2013 | Irani | |
| 2008/0148838 | A1* | 6/2008 | Irani | E21B 49/081 73/152.23 |
| 2008/0245570 | A1* | 10/2008 | Partouche | E21B 17/02 175/48 |
| 2009/0049904 | A1 | 2/2009 | Meister | |
| 2012/0166089 | A1 | 6/2012 | Ramshaw et al. | |
| 2012/0222852 | A1 | 9/2012 | Pelletier | |
| 2013/0025855 | A1 | 1/2013 | Glattetre et al. | |
| 2013/0199286 | A1* | 8/2013 | Gao | E21B 49/081 73/152.27 |

OTHER PUBLICATIONS

Cyrus Irani, "Pre-Filing Activity by Cyrus Irani", on or before year 2012 but describing , 1 page.

* cited by examiner

WELL FLUID SAMPLING CONFIRMATION AND ANALYSIS

BACKGROUND

This application is a U.S. National Phase Application under 35 U.S.C. §371 and claims the benefit of priority to PCT Application Serial No. PCT/US2013/078266, filed on Dec. 30, 2013 and entitled "Well Fluid Sampling Confirmation and Analysis", which claims priority to U.S. Provisional Application Ser. No. 61/878,243, filed on Sep. 16, 2013 and entitled "Well Fluid Sampling Confirmation and In-Situ Analysis", the contents of which are hereby incorporated by reference.

This disclosure relates, in general, to testing and evaluation of subterranean formation fluids.

In drilling subterranean wells, testing is performed to obtain a fluid sample from the formation to, among other things, determine the composition of the formation fluids. In this testing, efforts are taken to obtain a sample of the formation fluid that is representative of the fluids as they exist in the formation. In a typical sampling procedure, a sample of the formation fluids may be obtained by lowering a sampling tool having a sampling chamber into the wellbore on a conveyance, such as a wireline, slick line, coiled tubing, jointed tubing or the like. When the sampling tool reaches the desired depth, one or more ports are opened to allow collection of the formation fluids. Once the ports are opened, formation fluids travel through the ports and a sample of the formation fluids are collected within a sampling chamber of the sampling tool. After the sample has been collected, the sampling tool is withdrawn from the wellbore so that the formation fluid sample may be analyzed.

As the fluid sample is retrieved to the surface, the temperature of the fluid sample tends to decrease causing shrinkage of the fluid sample and a reduction in the pressure of the fluid sample. These changes can cause the fluid sample to approach or reach saturation pressure, creating the possibility of flashing entrained gasses present in the fluid sample and subsequent asphaltene deposition. Once such a process occurs, the resulting fluid sample is no longer representative of the fluids present in the formation. Therefore, a need has arisen for obtaining a fluid sample from a formation without degradation of the sample during retrieval of the sampling tool from the wellbore. A need has also arisen for maintaining the integrity of the fluid sample during storage on the surface

DESCRIPTION OF DRAWINGS

Like reference symbols in the various drawings indicate like elements.

DETAILED DESCRIPTION

Figure 1:
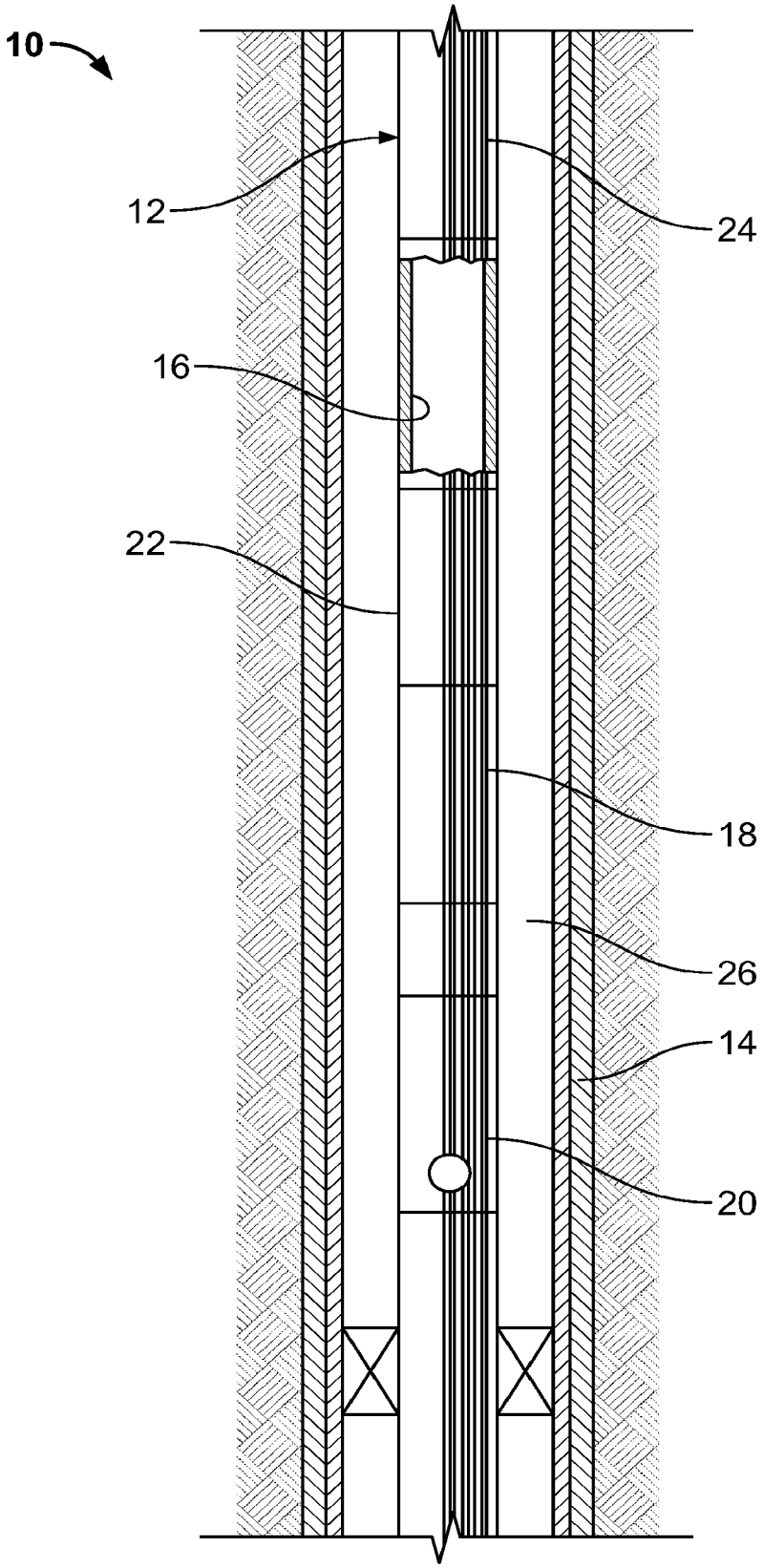
FIG. 1 is a schematic half cross-sectional view of a fluid sampler system in a subterranean well.
Figure 2A:
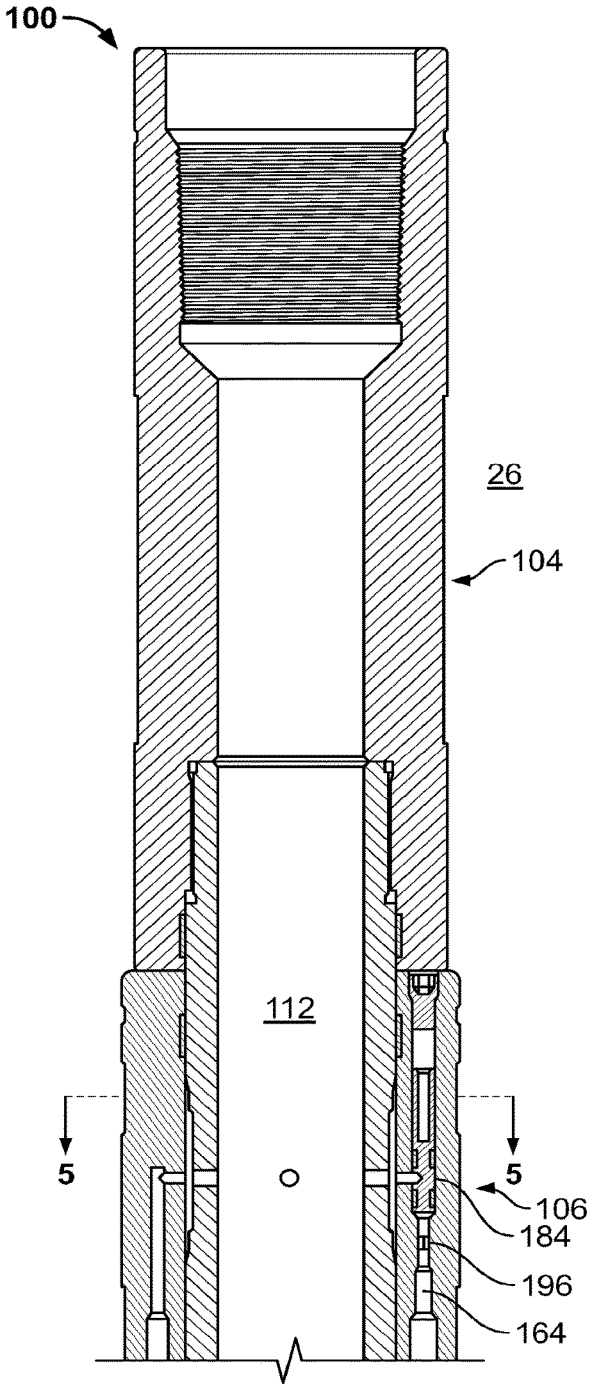
FIGS. 2A-E arc half cross-sectional views of an example fluid sampler.
Figure 2B:
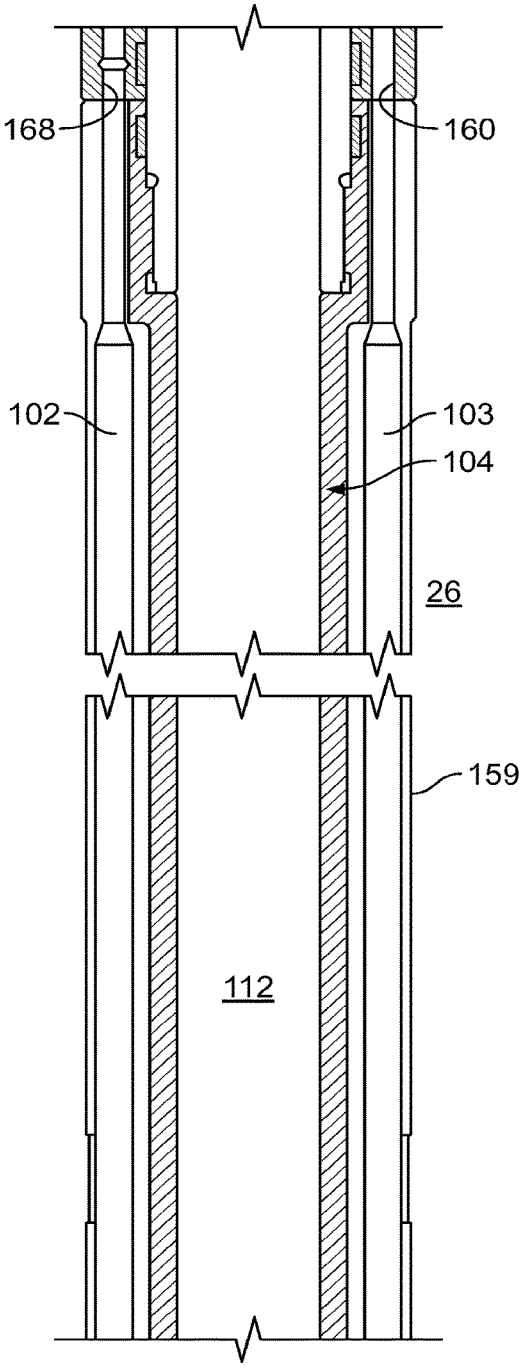
Figure 2C:
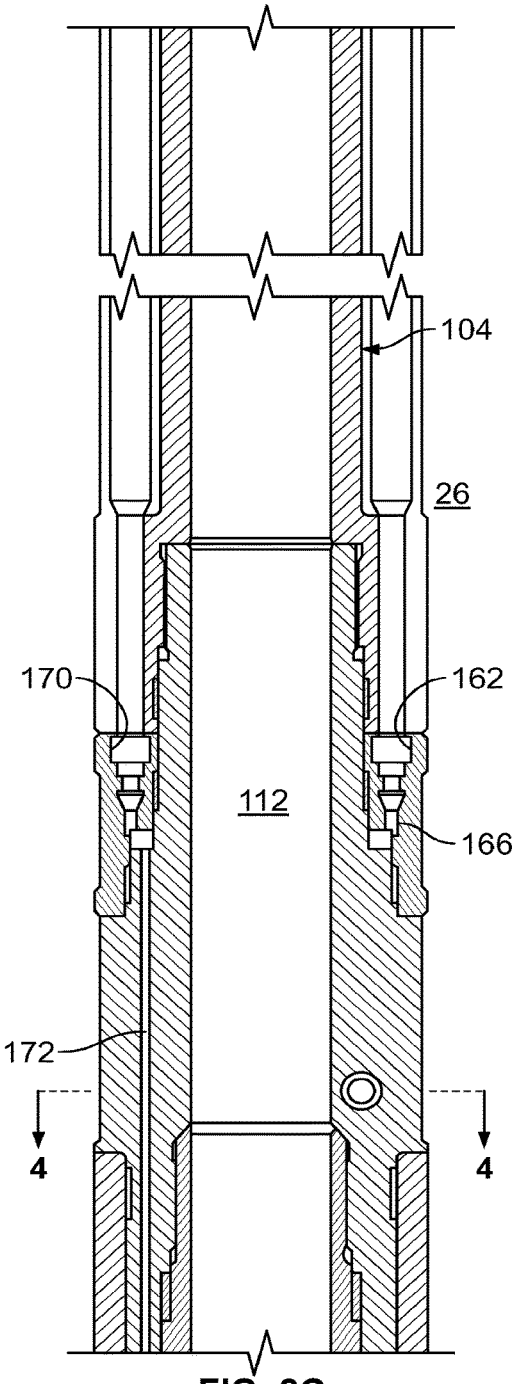
Figure 2D:
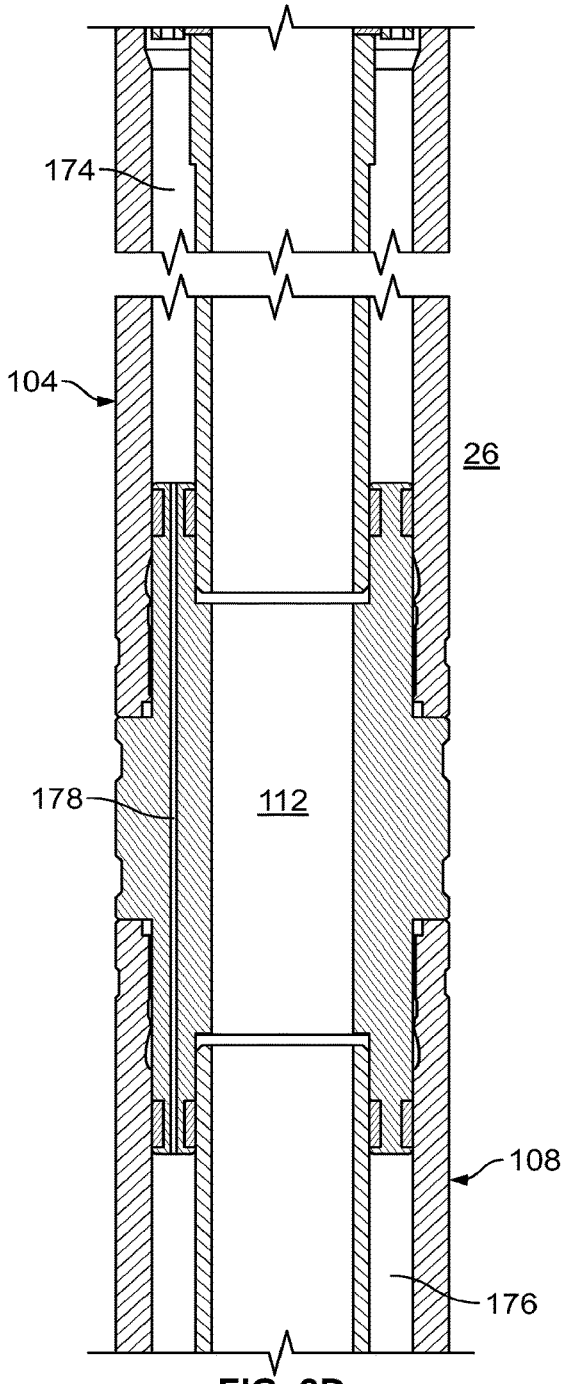
Figure 2E:
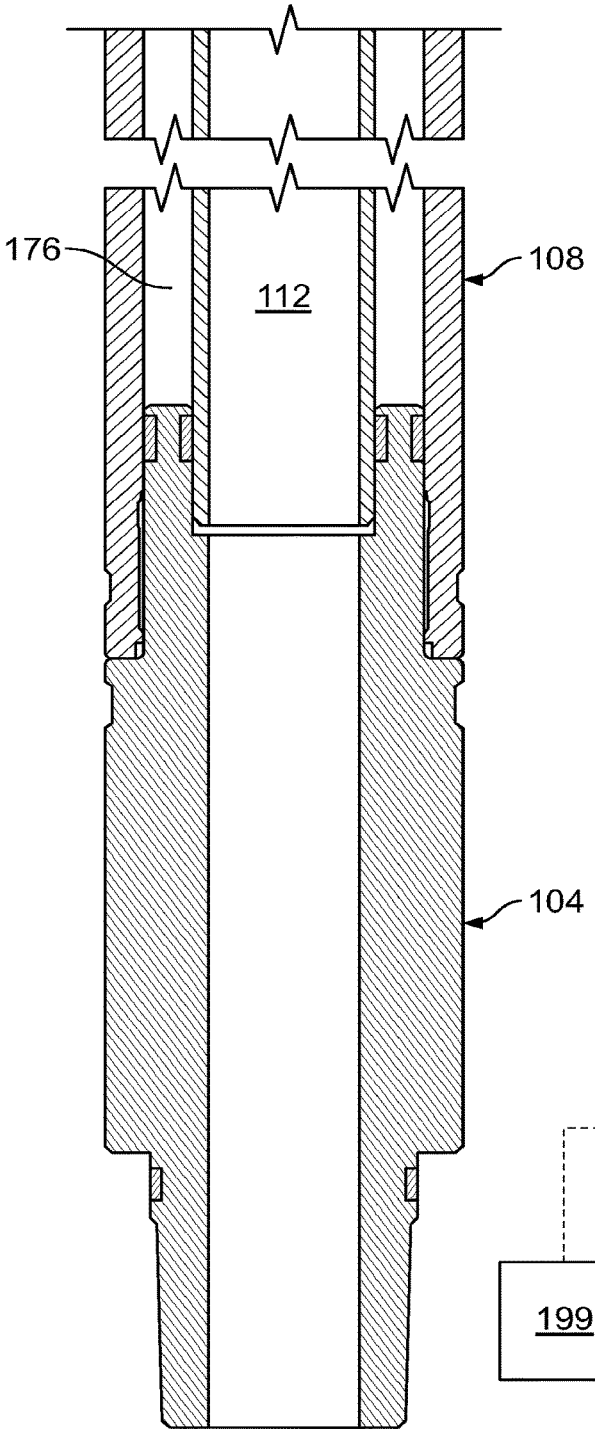

Referring initially to FIG. 1, an example fluid sampler system 10 is shown as part of a tubular string 12, such as a drill stem test string, positioned in a wellbore 14. A central bore 16 extends longitudinally through the string 12. The tubular string 12 is shown including a sampler 18, a circulating valve 20, a tester valve 22 and a choke 24, but in other instances, the string 12 can include fewer or additional components.

The sampler 18 selectively operates to open, receive well fluid into one or more sampling chambers, and then close for transport of the well fluid sample to the surface. Circulating valve 20 selectively permits and prevents flow between bore 16 and an annulus 26 between tubular string 12 and wellbore 14. The tester valve 22 selectively permits and prevents flow through bore 16. Choke 24 selectively restricts flow through tubular string 12. In certain instances, sampler 18, valves 20, 22 and choke 24 may be operated by a remote signal, including; by a pressure signal (e.g., manipulating pressure in annulus 26 from the surface), by an electrical signal, by an acoustic signal, or by another type of signal, and each need not respond to the same type of signal.

Notably, in other instances, the sampler 18 could be conveyed through bore 16 using a wire (e.g., wireline, e-line, slickline) or coiled tubing. The configuration of wellbore 14 shown in FIG. 1 is for convenience of reference only, and the wellbore 14 could be differently configured (e.g., partially open hole instead of cased, deviated instead of vertical, and/or other differences) .

Referring now to FIGS. 2A-2E, one example fluid sampler 100 that can be used as sampler 18 includes a carrier 104 that receives and carries one or more sampling chambers 102. The sampling chambers 102 are of a type that are selectively actuated open and closed to receive and store samples of fluids from the bore of the sampler 100 (e.g., bore 16). The sampling chambers 102 can be of various configurations. For example, U.S. Pat. Nos. 7,596,995, 7,472,589 and 7,197,923 disclose several examples of sampling chambers that could be used as sampling chambers 102. Other examples exist. The carrier 104 can also be as described in these patents. Other examples exist. As described in more detail below, the carrier 104 also includes an actuator 106 for actuating the sampling chambers 102 and a pressure source 108 used by the sampling chambers 102 to maintain pressure on the collected samples.

The one or more of the sampling chambers 102 are installed within exteriorly disposed chamber receiving slots 159 arrayed around the internal fluid bore 112 of carrier 104. A seal bore 160 (see FIG. 2B) is provided in carrier 104 at each slot 149 for receiving the upper portion of sampling chamber 102 and another seal bore 162 (see FIG. 2C) is provided at each slot 159 for receiving the lower portion of sampling chamber 102. In certain instances, the carrier 104 includes ten slots 159 and nine of the slots are taken by sampling chambers 102. Other numbers of slots 159 and sampling chambers 102 could be used. The inlet to sampling chamber 102 is placed in sealed communication with a bore 164 in carrier 104, and passage 156 in the lower portion of sampling chamber 102 is placed in sealed communication with a bore 166 in carrier 104.

In addition to the sampling chambers 102 installed within carrier 104, a pressure and temperature gauge/recorder 103 can also be received in carrier 104 in a similar manner. In an example with ten slots 159 occupied by seven sampling chambers 102, pressure and temperature gauge/recorders 103 can occupy the remaining three slots 159. Seal bores 168, 170 in carrier 104 provide communication between one of the gauge/recorders 103 and internal fluid bore 112, so that the one gauge/recorder 103 can measure pressure and temperature of the fluids in the bore 112. Another of the gauge/recorders 103 can be configured to measure pressure and temperature of fluids in the annulus around the sampler 100. Finally, another of the gauge/recorders 103 is configured to measure pressure (and temperature, if desired) from passage 172 via bore 166, and thus measure characteristics of the pressure source 108 (discussed in more detail below). The gauge/recorders 103 can be coupled to a downhole telemetry system for communicating pressure and temperature readings to the surface, concurrently as readings are being taken (e.g., in real time and/or without substantial delay). In other instances, fewer or more gauge/recorders 103 can be provided. For example, in certain instances, one or both of the gauge/recorders 103 measuring the pressure and temperature in bore 112 or in the annulus is omitted.

Passage 172 is in communication with the sample chambers 102 and chamber 174 of pressure source 108. Chamber 174 is in communication with chamber 176 of pressure source 108 via a passage 178. Chambers 174, 176 initially contain a pressurized fluid, such as a compressed gas or liquid. In certain instances, compressed nitrogen at between about 7,000 psi and 12,000 psi is in chambers 174, 176, but other fluids or combinations of fluids and/or other pressures both higher and lower could be used, if desired. Even though FIG. 2 depicts pressure source 108 as having two fluid chambers 174, 176, it could have any number of chambers, including being only one continuous chamber.

The actuator 106 includes multiple valves 184 operated in response to a remote signal, for example via the telemetry system, to provide for separate actuation of multiple sampling chambers 102. In certain instances, the sampling chambers 102 can be divided up into groups of sampling chambers and the sampling chambers 102 in each group, actuated concurrently. In the example with nine sampling chambers 102, in certain instances, the chambers 102 can be actuated in three groups of three chambers 102 each. If actuated in groups, one valve 184 can be associated with each group of sampling chambers 102 to actuate the chambers 102 in the group concurrently.

For each group of sampling chambers 102, valve 184 initially isolates a bore 164, which is in communication with the group of the sampling chambers 102 via passage 196, from internal fluid bore 112 of fluid sampler 100. This isolates sample chamber 102 in each of the group of sampling chambers 102 from bore 112. When it is desired to receive a fluid sample into a group of the sample chambers 114, a remote signal is provided into the well, via the telemetry system, to actuate the valves 184 and open the bore 164. Fluid from bore 112 then enters each of the three sampling chambers 102.

After the sampling chambers 102 receive fluid from bore 112, pressure in pressure source 108 is applied to chambers 102 to apply pressure to the fluid sample received in the chambers 102. The fluid sample and the pressure from the pressure source 108 are then sealed in separate, but pressure communicating chambers. The pressure in pressure source 108 is thus able to act on the fluid sample and preserve the fluid sample in the sampling chambers 102 above a specified pressure, e.g., above the saturation pressure of the fluid sample. Each time the pressure source 108 is operated to supply pressure to the sampling chambers 102, the pressure in the pressure source 108 drops.

In the illustrated example, the same pressure source 108 is used for all the fluid samples taken. That is, pressure source 108 is in communication with each of the multiple sampling chambers 102. Once all the samples are obtained and pressurized downhole, fluid sampler 100 is retrieved to the surface. Even though the fluid samples may cool as withdrawn to the surface, the common pressure source maintains the samples at a suitable pressure to prevent any phase change degradation. Once on the surface, the sample may remain in the multiple sampling chambers 102 for a considerable time during which temperature conditions may fluctuate. Accordingly, a surface pressure source, such a compressor or a pump, may be used to supercharge the sampling chambers 102. This supercharging process allows multiple sampling chambers 102 to be further pressurized at the same time with sampling chambers 102 remaining in carrier 104 or after sampling chambers 102 have been removed from carrier 104.

Figure 3:
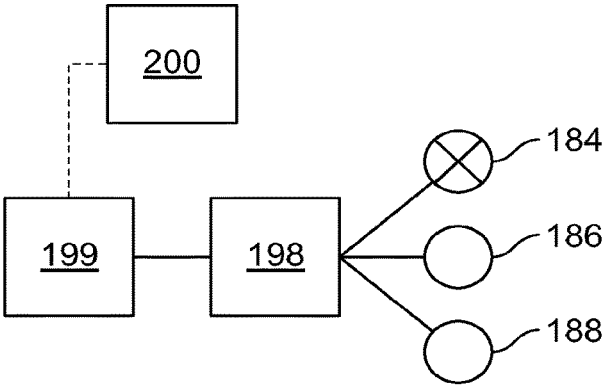
FIG. 3 is a schematic of the telemetry and controller of the example fluid sampler of FIGS. 2A-E.

Referring now to FIG. 3, a control module 198 included in fluid sampler 100 is used to actuate valves 184, interface with the sensors 186 of the gauge/recorder 103 and interface with other devices 188 of the fluid sampler 100. A telemetry communicator 199 may be connected to control module 198 to communicate remote signals to and from the module 198. In certain instance the telemetry communicator 199 communicates with a computer 200 outside of the well, e.g. at the surface. Communicator 199 may be any type of telemetry receiver, such as a receiver capable of receiving acoustic signals, pressure pulse signals, electromagnetic signals, mechanical signals or the like. In one instance, the telemetry communicator 199 is a component of a wireless, real-time acoustic system that communicates with the surface via acoustic signals passed through the tubing string. An example of such a system is DynaLink, a registered trademark of Halliburton Energy Services, Inc.

When control module 198 determines that an appropriate signal, addressed to one or more of the valves 184, has been received by communicator 199, control module 198 actuates the addressed valves 184 to open, thereby causing fluid samples to be taken in corresponding fluid chambers 102. Likewise, the sensors of the gauge/recorder 103 can be monitored to provide measurements of pressure and temperature through control module 198 and communicator 199 to a location remote from the fluid sampler 100, e.g. a computer 200 outside of the well. The measurements can be communicated via the communicator 199 concurrently as readings are being taken (e.g., in real time and/or without substantial delay), and can be pushed by the controller 198 or can be provided in response to a remote query.

Information from the sensors 186 of the gauge/recorder 103 can be used to determine whether the sampling chambers 102 have been operated to collect a sample. The pressure in the pressure source 108 will drop each time the pressure source 108 is used to supply pressure to a sampling chamber 102. For example, a human operator and/or the computer 200 outside of the well can watch the pressure readings from the pressure source 108 for a change in pressure of specified amount. The specified amount can correspond to the expected pressure change in the pressure source 108 when it supplies pressure to a sampling chamber or a group of sampling chambers 102. The operator and/or computer 200 can look for changes in pressure for each sampling chamber 102 or group of sampling chambers 102 operated, to determine that one, multiple or all of the sampling chambers 102 have operated. Since the readings from the sensors 186 can be communicated concurrently as they are being taken, the operator will know that the sampling chambers 102 and how many sampling chambers 102 have operated while the fluid sampler 100 is still in the well. If the sampling was unsuccessful, the operator can re-signal the sampling chambers 102 or signal a second group of sampling chambers 102 to re-attempt the sampling. Notably, the operator does not have to trip the fluid sampler 100 out of the well to determine that a sample collection step was unsuccessful, nor does the operator have to trip the fluid sampler 100 back into the well to take another sample.

In addition to determining that operation of the sampling chamber 102 was successful, the operator can obtain an indication of the type of sample taken by the sampling chamber 102 based on the readings from the pressure sensor 186. Prior to operation, the contents and initial conditions (e.g., pressure and temperature) of sampling chambers 102 and the pressure source 108 are known. Similarly, the conditions (e.g., pressure and temperature) of the fluids at the sampling location are known or can be measured by in-well sensors 186. By measuring the change in pressure in the pressure source 108 as the sampling chambers 102 are operated, the operator and/or the computer 200 can back calculate the change in pressure due to the compression of the sample in the sampling chamber 102, and by comparison of this compressibility to known characteristics of reservoir fluids, determine the type of fluid in the sampling chamber.

For example, in certain instances, the sampling chamber 102 upon sampling will contain about 2 cc's of compressed air, about 400 cc's of a compressed initial fluid at close to reservoir pressure, and about 400 cc of collected sample at reservoir pressure. In certain instances, the initial fluid can be a heat transfer fluid such as Paratherm, a registered trademark of the Paratherm Corporation. For sake of discussion, the reservoir pressure in this example is known to be 5000 psi, and pressure in the pressure source 108 at reservoir temperature is 15,000 psi. The pressure source 108 has been charged with nitrogen. As the nitrogen is released, it will compress the initial fluid and the collected sample from 5000 psi to close to 15,000 psi, and in doing so, the nitrogen pressure in the pressure source 108 will fall commensurate with the increase in nitrogen volume due to compression of initial fluid and collected sample. The numerical value for the compressibility of the initial fluid is known, and consequently the shrinkage of the initial fluid due to the pressure surge, and the corresponding increase in nitrogen volume along with the decrease in nitrogen pressure can be readily calculated.

Accordingly, when the samplers are activated there will be a drop in nitrogen pressure, while the drop in this overall pressure due entirely to the compression of the initial fluid can be readily calculated. Consequently, the remaining measured pressure drop of the nitrogen has to be entirely due to the compression of the collected sample, and this compression of the sample can be used to identify the type of fluid that has been collected by comparison to known characteristics of reservoir fluids. A convenient generic classification of reservoir fluids includes four categories: Black Oils, Volatile Oils including Critical Fluids, Condensates including Wet Gases, and Dry Gas. Each of these hydrocarbon types will have a characteristic compressibility, while collectively they will define a continuum, with the Black Oil systems, which are primarily liquid systems being least compressible, while the condensates and dry gases will be most compressible. Because of this compressibility variation, if a Black Oil sample is collected, then because of its lower compressibility it will result in a higher nitrogen pressure being reported when the nitrogen charge is activated relative to the case where a Condensate or Dry Gas system is collected.

In general each of the hydrocarbon types can be given an average compressibility, and that compressibility can be used to define a corresponding pressure drop. This sample related pressure drop is the only variable so that starting with the overall pressure drop and subtracting the initial fluid related pressure drop, the remaining pressure drop of the nitrogen can be directly related to a particular fluid type.

Consequently, in addition to determining that the sampling chambers 102 have operated, concurrently with the operation of the chambers 102, the operator can determine the reservoir fluid type that represents the collected sample. As above, the analysis can be performed with the fluid sampler 100 in the well, and it need not be tripped out of the well to determine the fluid type.

Therefore, certain aspects encompass an in-well type sampling system. The in-well type sampling system includes a sampling chamber actuable to receive a fluid sample and a pressure source coupled to the sampling chamber to supply pressure to the sampling chamber after actuating the sampling chamber. A pressure sensor is provided in communication with the pressure source to measure the pressure of the pressure source. A telemetry communicator is coupled to the pressure sensor to send a signal from the pressure sensor away from the sampling system.

Certain aspects encompass a method where a sample of reservoir fluids is received into a sample chamber of a sampling system in a well. A pressure from a pressure source of the sampling system is applied to the sample in the sample chamber. A measurement of the pressure in the pressure source, taken after applying pressure to the sample, is communicated to a location away from the sampling system.

Certain aspects encompass a system having an in-well type sampling device including a sampling chamber coupled to a pressure source and a pressure sensor to measure pressure of the pressure source. The system includes a monitor to monitor the pressure sensor and determine a sample has been collected in the sample chamber based on the monitoring of the pressure sensor.

The aspects above can include some, none or all of the following features. A computer can be provided to reside outside of a well to receive communication from the telemetry communicator and determine that the sampling chamber has operated to receive a sample based on the signal from the pressure sensor. In certain instances, the computer can determine the sampling chamber has operated to receive a sample when a change in pressure of the pressure source is greater than a specified change in pressure. The telemetry communicator can be coupled to the pressure sensor to send a signal from the pressure sensor away from the sampling system concurrently as the pressure sensor is measuring the pressure of the pressure source. The computer can determine the type of fluid collected in the sampling chamber based on the signal from the pressure sensor. For example the computer can determine the type of fluid collected in the sampling chamber when a change in pressure of the pressure source is equal to a specified change in pressure. In certain instances, the computer can determine the type of fluid collected in the sampling chamber is one of black oil, volatile oil, condensate, or dry gas. In certain instances, prior to sampling, the sampling chamber comprises initial contents, and the computer can determine the type of fluid collected in the sampling chamber by accounting for the compressibility of the initial contents.

A number of embodiments have been described. Nevertheless, it will be understood that various modifications may be made. Accordingly, other embodiments are within the scope of the following claims.

What is claimed is:

1. An in-well type sampling system, comprising:

a fluid sampler comprising a carrier chamber having an internal fluid bore and a receiving slot exteriorly disposed to the internal fluid bore;

a sampling chamber located within the receiving slot and actuable to receive a fluid sample;

a pressure source coupled to the sampling chamber to supply pressure to the sampling chamber after actuating the sampling chamber;

a pressure sensor in communication with the pressure source to measure the pressure of the pressure source; and a telemetry communicator coupled to the pressure sensor to send a signal from the pressure sensor away from the sampling system; and a computer to reside outside of a well to receive communication from the telemetry communicator and determine a type of fluid is collected in the sampling chamber based on a signal from the pressure sensor indicating a decrease in the pressure of the pressure source.

2. The in-well type sampling system of claim 1, where the computer determines the sampling chamber has operated to receive a sample when a change in pressure of the pressure source is greater than a specified change in pressure.

3. The in-well type sampling system of claim 1, where the telemetry communicator is coupled to the pressure sensor to send a signal from the pressure sensor away from the sampling system concurrently as the pressure sensor is measuring the pressure of the pressure source.

4. The in-well type sampling system of claim 1, where the computer determines the type of fluid collected in the sampling chamber when a decrease in pressure of the pressure source is equal to a specified change in pressure.

5. The in-well type sampling system of claim 1, where the computer determines the type of fluid collected in the sampling chamber is one of black oil, volatile oil, condensate, or dry gas.

6. The in-well type sampling system of claim 1, where prior to sampling, the sampling chamber comprises initial contents, and where the computer determines the type of fluid collected in the sampling chamber by accounting for the compressibility of the initial contents.

7. The in-well type sampling system of claim 1 , where the computer is further to determine the type of fluid collected in the sampling chamber based on the signal from the pressure sensor.

8. A method, comprising:

receiving a sample of reservoir fluids into a sample chamber of a sampling system in a well, wherein the sample chamber is located within a receiving slot located exteriorly to an internal fluid bore of a carrier;

applying a pressure from a pressure source of the sampling system to the sample in the sample chamber; and communicating a measurement of a decrease in the pressure in the pressure source, taken after applying pressure to the sample, to a location away from the sampling system to determine that the sample is collected; and determining a type of fluid in the sample chamber based on the measurement of the pressure.

9. The method of claim 8, where communicating the measurement of the pressure in the pressure source to the location away from the sampling system comprises communicating the measurement to a location outside of the well.

10. The method of 8, comprising determining that the sample of reservoir fluids has been received into the sample chamber based on the measurement of the pressure.

11. The method of 8, comprising determining that the sample of reservoir fluids has been received into the sample chamber without withdrawing the sampling system from the well.

12. The method of claim 8, comprising determining that the type of fluids is one of black oil, volatile oil, condensate, or dry gas.

13. The method of claim 8, further comprising receiving a second sample of reservoir fluids into a second sample chamber of the sampling system in the well;

applying a pressure from the pressure source to the second sample in the second sample chamber;

communicating a second measurement of the pressure in the pressure source, taken after applying pressure to the second sample, to a location away from the sampling system; and determining that the second sample of reservoir fluids has been received into the second sample chamber based on the second measurement of the pressure.

14. The method of claim 8, comprising determining the type of fluids in the second sample chamber based on the second measurement of the pressure.

15. A system, comprising:

an in-well type sampling device comprising a fluid sampler comprising a carrier having an internal fluid bore and receiving slots exteriorly disposed to the internal fluid bore and a sampling chamber located within one of the receiving slots and coupled to a pressure source and a pressure sensor to measure pressure of the pressure source; and a monitor to monitor the pressure sensor and determine a sample has been collected in the sample chamber based on the monitoring of a decrease in the pressure of the pressure source; and the monitor determines a type of fluid in the sampling chamber based on the monitoring of the pressure sensor.

16. The system of claim 15, where the monitor is a surface based computer.

* * * * *